US009453632B2

(12) United States Patent
Kang

(10) Patent No.: US 9,453,632 B2
(45) Date of Patent: Sep. 27, 2016

(54) LAMP FOR VEHICLE

(71) Applicant: HYUNDAI MOBIS CO., LTD., Seoul (KR)

(72) Inventor: Dong Gon Kang, Yongin (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 90 days.

(21) Appl. No.: 14/191,343

(22) Filed: Feb. 26, 2014

(65) Prior Publication Data

US 2015/0043237 A1 Feb. 12, 2015

(30) Foreign Application Priority Data

Aug. 6, 2013 (KR) ..... 10-2013-0093224

(51) Int. Cl.
*F21S 8/10* (2006.01)

(52) U.S. Cl.
CPC ..... *F21S 48/234* (2013.01); *F21S 48/1154* (2013.01); *F21S 48/1159* (2013.01); *F21S 48/1258* (2013.01); *F21S 48/1323* (2013.01); *F21S 48/1388* (2013.01); *F21S 48/1747* (2013.01); *F21S 48/215* (2013.01)

(58) Field of Classification Search
CPC .. F21S 48/234; F21S 48/215; F21S 48/1154; F21S 48/1747; F21S 48/1258; F21S 48/1323; F21S 48/1388; F21S 48/1159
See application file for complete search history.

(56) References Cited

U.S. PATENT DOCUMENTS 437,932 A * 10/1890 Kelly ..... A63F 9/0826 273/153 S
4,862,329 A * 8/1989 Nino ..... F21S 48/145 362/214
4,962,450 A * 10/1990 Reshetin ..... F21S 48/1329 362/268
2004/0022067 A1* 2/2004 Taniuchi ..... B60Q 1/12 362/517
2004/0228139 A1* 11/2004 Taniuchi ..... B60Q 1/085 362/539
2006/0098450 A1* 5/2006 Iwasaki ..... 362/545
2007/0069580 A1* 3/2007 Ohshio ..... F21S 48/1388 307/10.8
2008/0316763 A1* 12/2008 Albou ..... B60Q 1/0035 362/538
2009/0284979 A1* 11/2009 Iwasaki ..... 362/517
2010/0046243 A1* 2/2010 Yatsuda ..... F21S 48/1154 362/538
2010/0124070 A1* 5/2010 Ochiai ..... F21S 48/1145 362/512
2011/0013412 A1* 1/2011 Kobayashi ..... F21S 48/114 362/538
2011/0170306 A1* 7/2011 Yatsuda ..... B29C 45/0025 362/512
2013/0058118 A1* 3/2013 Abe ..... F21S 48/1159 362/519
2013/0215634 A1* 8/2013 Tseng ..... F21S 48/1159 362/516
2013/0242585 A1* 9/2013 Brendle ..... F21S 48/125 362/487
2014/0233251 A1* 8/2014 Kropac et al. ..... 362/511
2014/0286033 A1* 9/2014 Soda et al. ..... 362/514
2014/0307458 A1* 10/2014 Brendle ..... F21S 48/1154 362/516
2014/0321140 A1* 10/2014 Brendle ..... F21S 48/12 362/511

FOREIGN PATENT DOCUMENTS

JP 2001-332104 A 11/2001
KR 10-2012-0120432 A 11/2012

* cited by examiner

*Primary Examiner* — Anh Mai
*Assistant Examiner* — Fatima Farokhrooz

(57) ABSTRACT

Provided is a lamp for a vehicle. The lamp includes: a first reflector disposed above an LED array and including an elliptical reflective surface that defines a first focal point and a second focal point; and a second reflector disposed below the LED array and including a parabolic reflective surface that defines a third focal point, and may increase an amount of light in a front region and a light width region of a vehicle by utilizing the existing light source without adding a separate light source.

5 Claims, 8 Drawing Sheets

LAMP FOR VEHICLE

CROSS-REFERENCE TO RELATED APPLICATIONS

This application claims priority to and the benefit of Korean Patent Application No. 10-2013-0093224 filed in the Korean Intellectual Property Office on Aug. 6, 2013, the entire contents of which are incorporated herein by reference.

FIELD

The present invention relates to a lamp for a vehicle, and more particularly, to a lamp for a vehicle which uses a multi-array type LED array as a light source.

BACKGROUND

Various types of bulbs have been used initially as a light source for a lamp of a vehicle, but recently, a light emitting diode (LED), which has excellent light conversion efficiency and a low amount of heat radiation, may be reduced in size and weight, and has a long lifespan, has been widely used as a light source.

In general, the LED has an advantage in that a color temperature of the LED is about 5,500 K, which is close to a color temperature of sunlight, so as to greatly reduce eye strain that causes fatigue, and the LED has an advantage in that a size of the LED is small so as to increase a degree of design freedom when a lamp for a vehicle is designed.

An LED array is a type of light source formed by mounting a plurality of LEDs, and may directly produce various beam patterns by selectively turning on the plurality of LEDs. For this reason, the LED array may be applied to a head lamp and a rear lamp of a vehicle so as to be effectively used to produce various beam patterns.

The lamp for a vehicle may be configured by installing an aspherical lens in front of the LED array, and light passing through a focal point of the aspherical lens travels straight after passing through the aspherical lens. There is a characteristic in that when the focal point is positioned on an optical axis, the light passing through the aspherical lens travels straight parallel to the optical axis.

FIG. 1 is a photograph illustrating a lighting image of a lamp for a vehicle which uses an LED array as a light source, and uses an aspherical lens.

Considering a characteristic of the LED array in which a plurality of LEDs is typically disposed to be aligned in a predetermined direction, there is a problem in that an amount of light in an A region illustrated in FIG. 1, that is, a front region and a light width region of the vehicle is not sufficient, and the front region and the light width region become dark.

FIG. 2 is a view illustrating a low beam region of a general lamp for a vehicle, in accordance with an isolux curve, and FIG. 3 is a view illustrating a low beam region of a lamp for a vehicle which uses an LED array as a light source, in accordance with an isolux curve.

When comparing an isolux curve (5 lux) 1, which shows a low beam region of a general lamp for a vehicle as illustrated in FIG. 2, with an isolux curve (5 lux) 1, which shows a low beam region of a lamp for a vehicle which uses an LED array as a light source as illustrated in FIG. 3, it can be seen that an amount of light in a short distance region and a light width region 2 of a vehicle 10 is insufficient for the latter rather than the former.

As a result, there is a problem in that in a case in which an auxiliary light is not present, it is difficult for the lamp for a vehicle, which uses the LED array as a light source, to produce a low beam at night.

SUMMARY

The present invention has been made in an effort to provide a lamp for a vehicle which may provide a sufficient amount of light to a front region and a light width region of a vehicle without adding a separate light source.

An embodiment of the present invention provides a lamp for a vehicle, including: a first reflector disposed above an LED array and including an elliptical reflective surface that defines a first focal point and a second focal point; and a second reflector disposed below the LED array and including a parabolic reflective surface that defines a third focal point.

The first focal point may be positioned on the LED array, and the third focal point may be positioned at the second focal point.

The LED array may include: an upper array configured to produce a high beam; and a lower array disposed below the upper array and configured to produce a low beam.

An aspherical lens may be provided in front of the LED array.

Another embodiment of the present invention provides a lamp for a vehicle, including: a first reflector provided above an LED array and including an elliptical reflective surface that defines a first focal point and a second focal point; and a second reflector including a planar reflective surface disposed below the LED array.

The first focal point may be positioned on the LED array.

The LED array may include: an upper array configured to produce a high beam; and a lower array disposed below the upper array and configured to produce a low beam.

An aspherical lens may be provided in front of the LED array.

According to the lamp for a vehicle according to the embodiment of the present invention, the first reflector, which includes the elliptical reflective surface that reflects light emitted from the LED array, is formed above the light source, and the second reflector, which includes a parabolic reflective surface or a planar reflective surface that reflects forward the light reflected by the first reflector, is formed below the LED array, thereby increasing an amount of light in the front region and the light width region of the vehicle by utilizing the existing light source without adding a separate light source.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
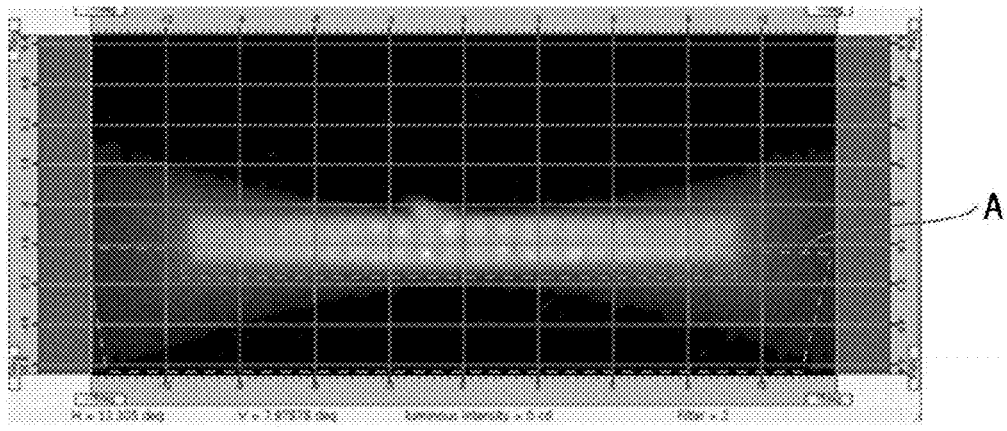
FIG. 1 is a photograph illustrating a lighting image of a lamp for a vehicle which uses an LED array as a light source, and uses an aspherical lens.
Figure 2:
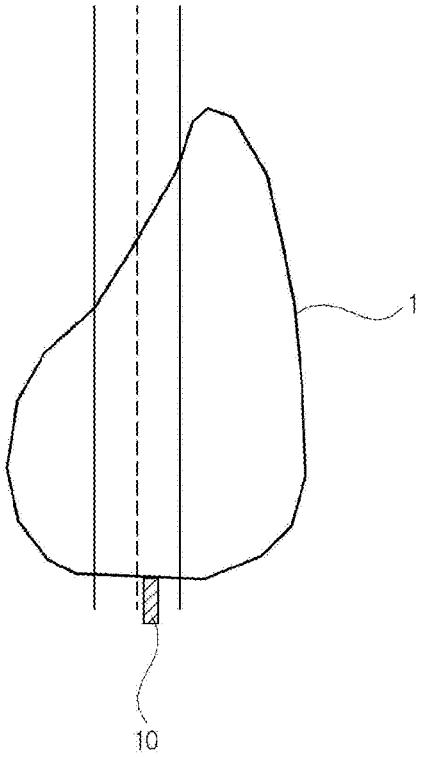
FIG. 2 is a view illustrating a low beam region of a general lamp for a vehicle, in accordance with an isolux curve.
Figure 3:
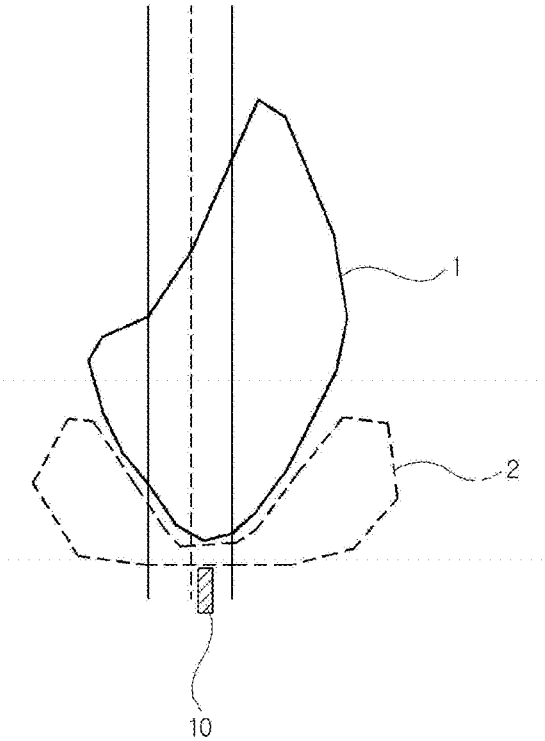
FIG. 3 is a view illustrating a low beam region of a lamp for a vehicle which uses an LED array as a light source, in accordance with an isolux curve.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, an embodiment of the present invention will be described in detail with reference to the accompanying drawings. First, in denoting reference numerals to constituent elements of respective drawings, it should be noted that the same elements will be designated by the same reference numerals although they are shown in different drawings. Hereinafter, embodiment of the present invention will be described, but, of course, the technical spirit of the present invention is not restricted or limited thereto, but the embodiment of the present invention may be modified by a person with ordinary skill in the art to be variously performed.

Figure 4:
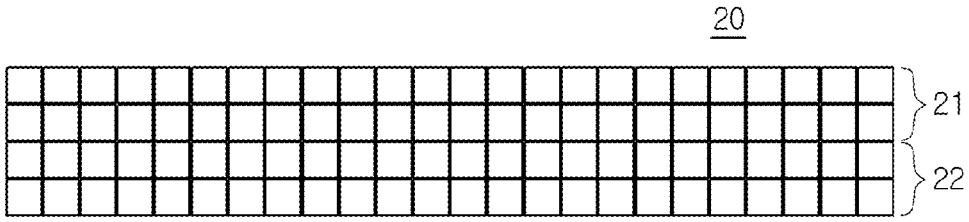
FIG. 4 is a view illustrating an LED array capable of producing a high beam and a low beam.

FIG. 4 is a view illustrating an LED array capable of producing a high beam and a low beam.

Referring to FIG. 4, an LED array 20 may include an upper array 21 that produces a high beam, and a lower array 22 that produces a low beam. The lower array 22 is disposed below the upper array 21.

Because LEDs of the upper array 21 are continuously turned on or off, the lower array 22 is utilized as a light source for increasing an amount of light in a front region and a light width region of a vehicle.

Figure 5:
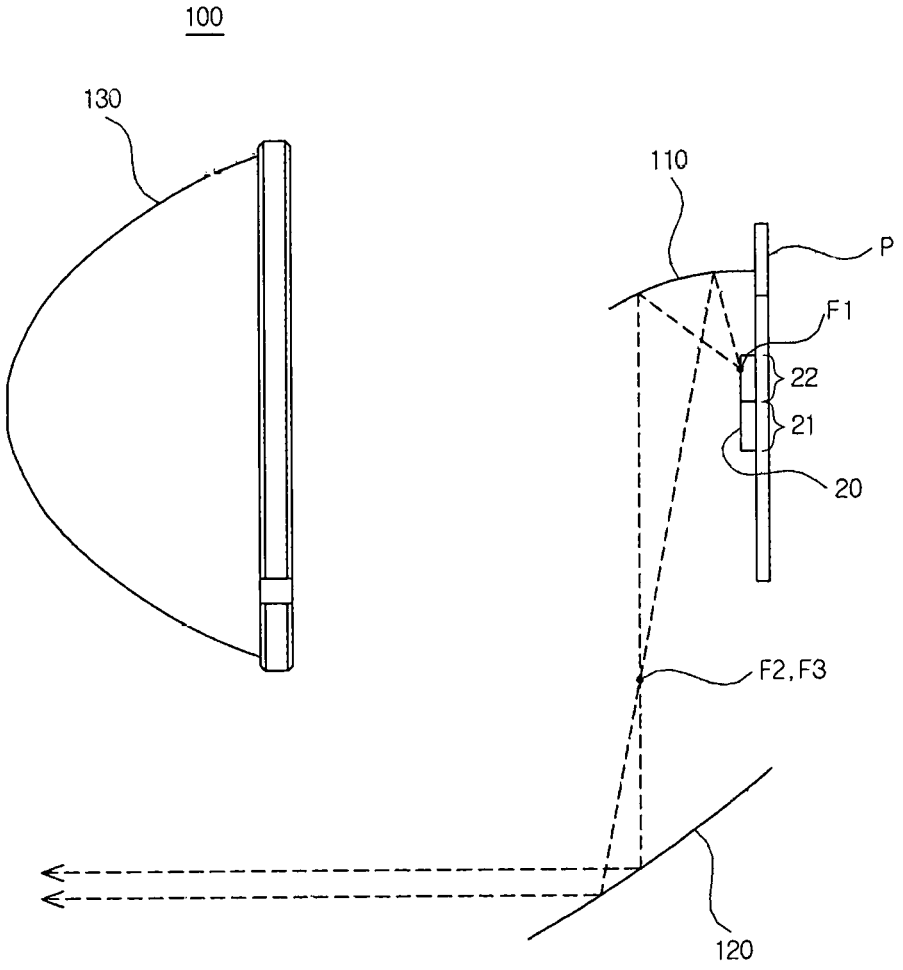
FIG. 5 is a view illustrating a lamp for a vehicle according a first embodiment of the present invention.

FIG. 5 is a view illustrating a lamp for a vehicle according to a first embodiment of the present invention. FIG. 5 clearly illustrates only a main characteristic part for conceptual and clear understanding of the present invention. As a result, various modifications to the illustrations are expected, and the scope of the present invention is not limited to specific shapes illustrated in the drawings.

Referring to FIG. 5, a lamp 100 for a vehicle according to the first embodiment of the present invention includes a first reflector 110 formed above the LED array 20, a second reflector 120 formed below the LED array 20, and an aspherical lens 130. Here, the LED array 20 is provided on a module P, and the aspherical lens 130 is installed in front of the LED array 20.

The first reflector 110 is provided above the LED array 20, and may include an elliptical reflective surface that forms a first focal point F1 and a second focal point F2. The first focal point F1 of the first reflector 110 may be positioned on the LED array 20. Specifically, the first reflector 110 may be formed so that the first focal point F1 is positioned at a center of the lower array 22 of the LED array 20.

The first reflector 110 may be configured so that multiple focal points are formed at an interval that corresponds to a width of an LED chip of the LED array 20.

The first reflector 110 serves to reflect light, which is emitted from the LED array 20, toward the second reflector 120.

The second reflector 120 is formed below the LED array 20, and may include a parabolic reflective surface that forms a third focal point F3. The third focal point F3 of the second reflector 120 may be positioned at the second focal point F2 of the first reflector 110. The second reflector 120 again reflects forward the light reflected by the first reflector 110, and supplies light to the front region and the light width region of the vehicle. An installation angle of the reflective surface of the second reflector 120 may be changed so as to correspond to the front region and the light width region of the vehicle which are targets.

Figure 6:
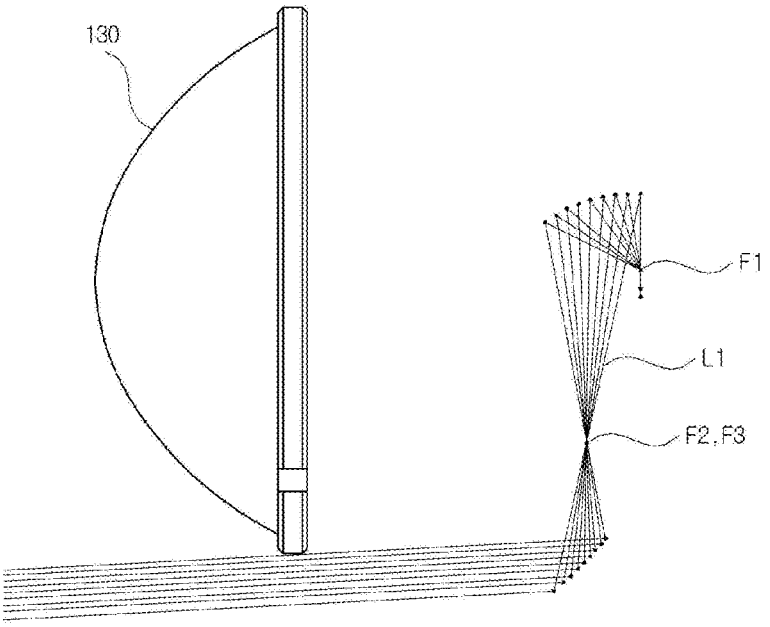
FIG. 6 is a view illustrating light paths formed by a first reflector and a second reflector illustrated in FIG. 5.

FIG. 6 is a view illustrating light paths formed by the first reflector and the second reflector illustrated in FIG. 5. Unlike light paths of a general LED array in the related art, the lamp 100 for a vehicle according to the first embodiment may send light L1 to the front region and the light width region of the vehicle, as illustrated in FIG. 6.

Figure 7:
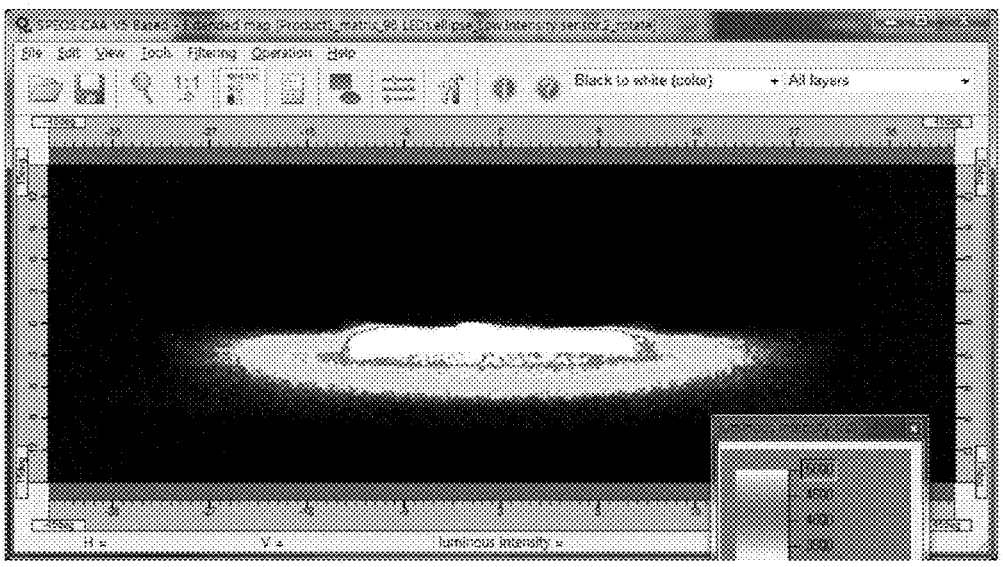
FIG. 7 is an isolux screen illustrating a state in which an amount of light in a front region and a light width region of a vehicle is increased by the first reflector and the second reflector illustrated in FIG. 5.
Figure 8:
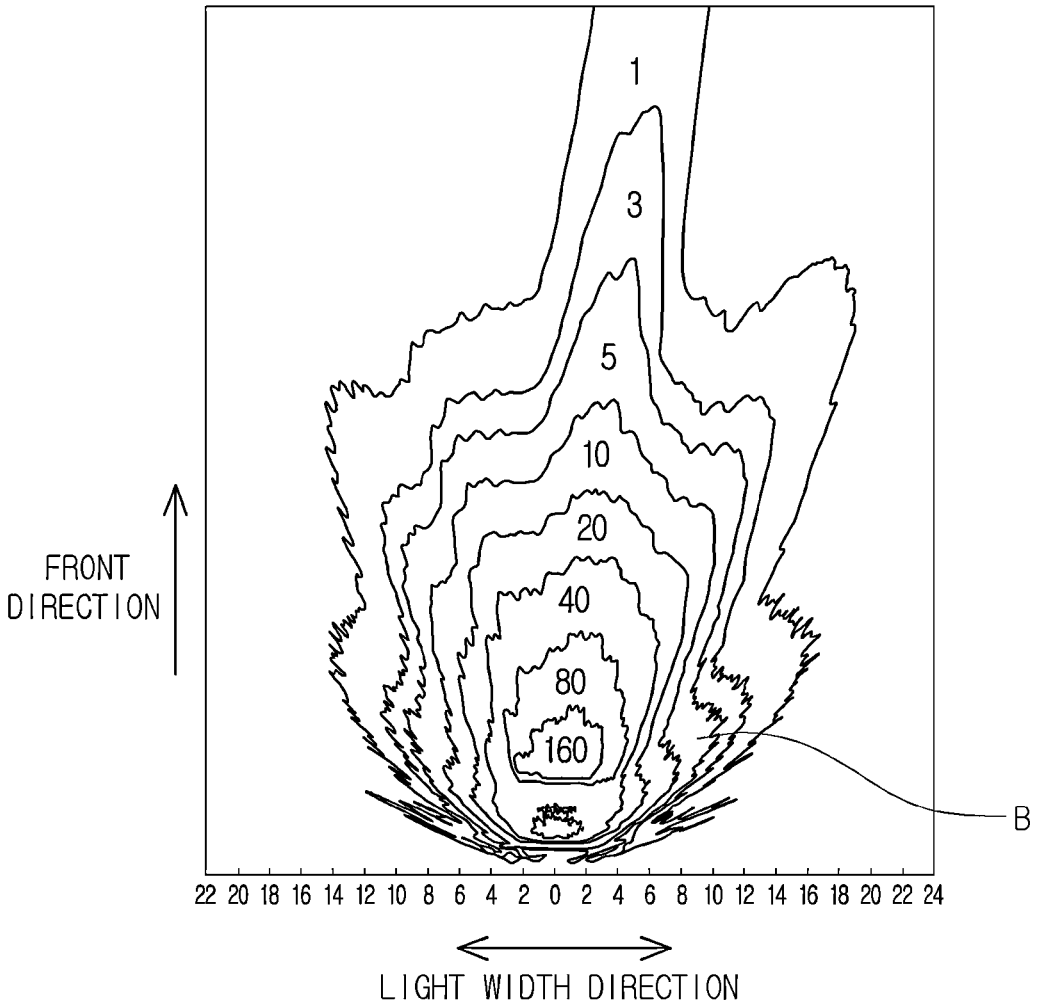
FIG. 8 is an isolux graph illustrating a state in which an amount of light in the front region and the light width region of the vehicle is increased by the first reflector and the second reflector illustrated in FIG. 5.

FIG. 7 is an isolux screen illustrating a state in which an amount of light in the front region and the light width region of the vehicle is increased by the first reflector and the second reflector illustrated in FIG. 5, and FIG. 8 is an isolux graph illustrating a state in which an amount of light in the front region and the light width region of the vehicle is increased by the first reflector and the second reflector illustrated in FIG. 5.

Referring to FIG. 7, it may be confirmed that the front region and the light width region of the vehicle are filled with light, and referring to FIG. 8, it can be confirmed that sufficient light reaches the regions in a front direction and a light width direction based on a 5 lux line that is indicated by B of FIG. 8.

Figure 9:
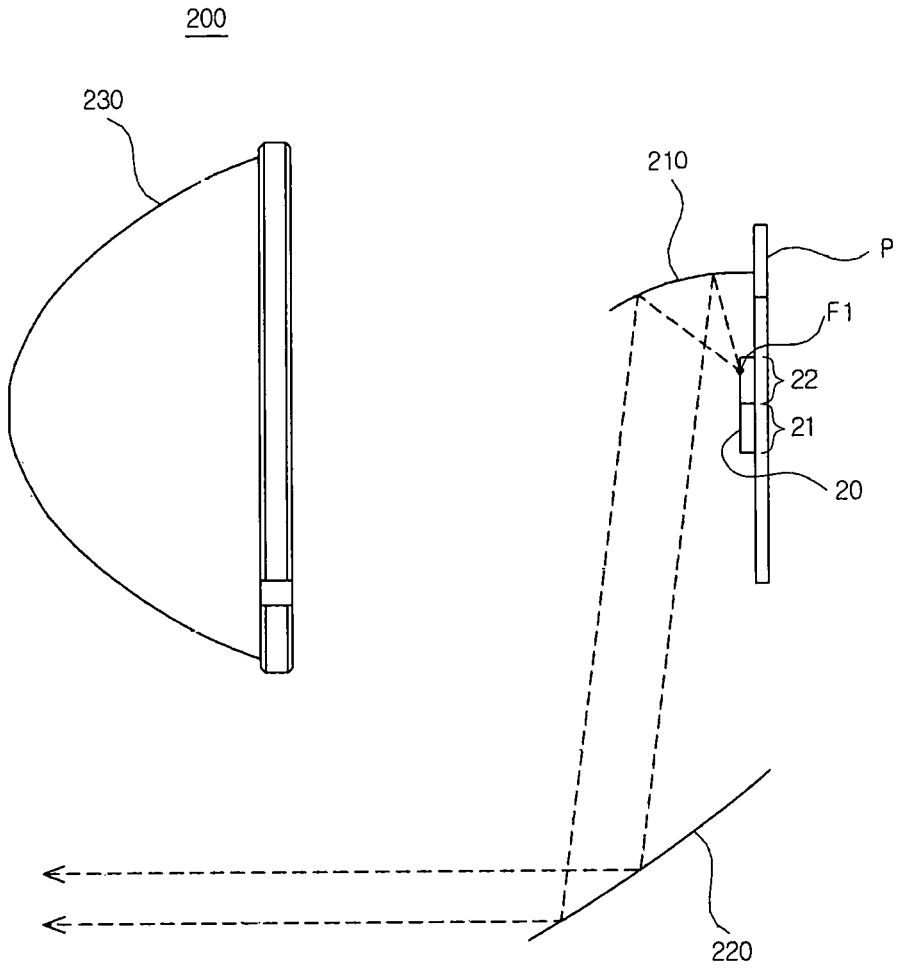
FIG. 9 is a view illustrating a lamp for a vehicle according to a second embodiment of the present invention.

FIG. 9 is a view illustrating a lamp for a vehicle according to a second embodiment of the present invention. FIG. 9 clearly illustrates only a main characteristic part for conceptual and clear understanding of the present invention. As a result, various modifications to the illustrations are expected, and the scope of the present invention is not limited to specific shapes illustrated in the drawings.

Referring to FIG. 9, a lamp 200 for a vehicle according to the second embodiment of the present invention includes a first reflector 210 formed above an LED array 20, a second reflector 220 formed below the LED array 20, and an aspherical lens 230.

Because the first reflector 210 is the same as the first reflector 110 of the aforementioned first embodiment in terms of configurations and functions, a detailed description thereof will be omitted.

The second reflector 220 is formed below the LED array 20, and may include a planar reflective surface. The second reflector 220 again reflects forward the light reflected by the first reflector 210, and supplies light to the front region and the light width region of the vehicle. In this case, an installation angle of the reflective surface of the second reflector 220 may be changed so as to correspond to the front region and the light width region of the vehicle which are targets.

Figure 10:
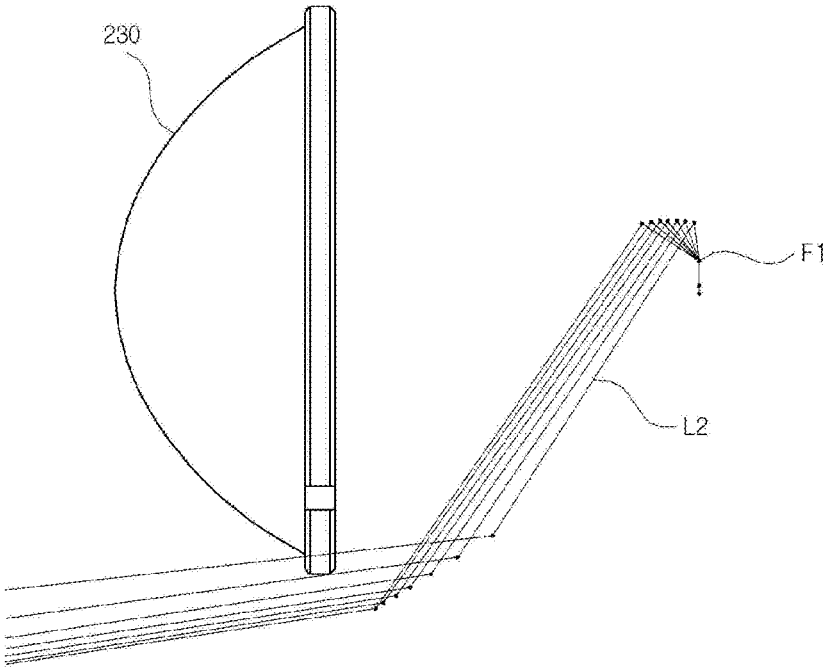
FIG. 10 is a view illustrating light paths formed by a first reflector and a second reflector illustrated in FIG. 9.

FIG. 10 is a view illustrating light paths formed by the first reflector and the second reflector illustrated in FIG. 9. Unlike light paths of a general LED array in the related art, the lamp (200 of FIG. 9) for a vehicle according to the second embodiment may send light L2 to the front region and the light width region of the vehicle, as illustrated in FIG. 10.

Figure 11:
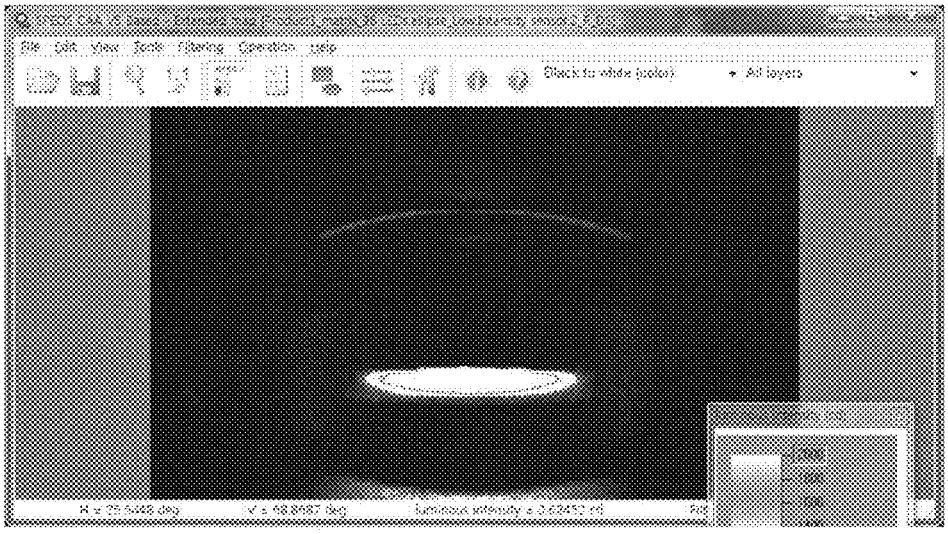
FIG. 11 is an isolux screen illustrating a state in which an amount of light in a front region and a light width region of a vehicle is increased by the first reflector and the second reflector illustrated in FIG. 9.
Figure 12:
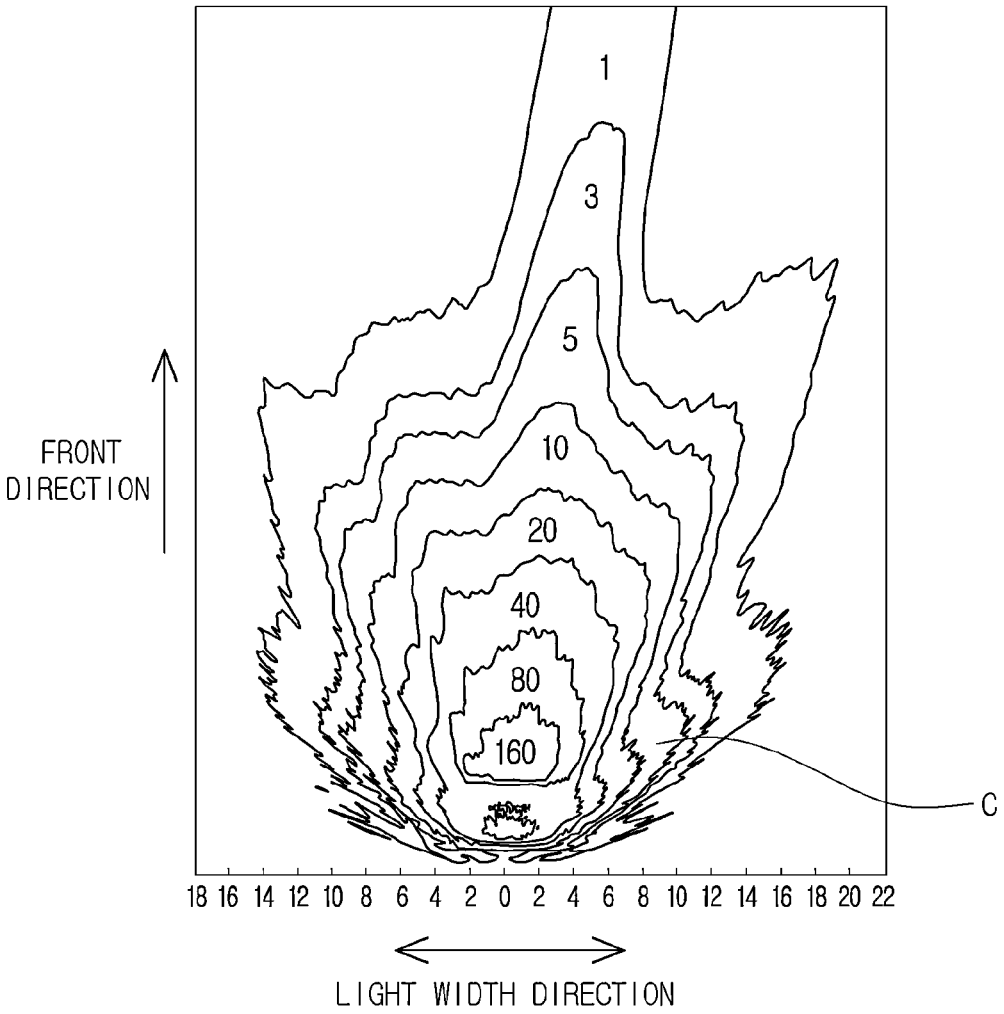
FIG. 12 is an isolux graph illustrating a state in which an amount of light in the front region and the light width region of the vehicle is increased by the first reflector and the second reflector illustrated in FIG. 9.

FIG. 11 is an isolux screen illustrating a state in which an amount of light in the front region and the light width region of the vehicle is increased by the first reflector and the second reflector illustrated in FIG. 9, and FIG. 12 is an isolux graph illustrating a state in which an amount of light in the front region and the light width region of the vehicle is increased by the first reflector and the second reflector illustrated in FIG. 9.

Referring to FIG. 11, it may be confirmed that the front region and the light width region of the vehicle are filled with light, and referring to FIG. 12, it can be confirmed that sufficient light reaches the regions in a front direction and a light width direction based on a 5 lux line that is indicated by C of FIG. 12.

As described above, the embodiments have been described and illustrated in the drawings and the specification. The embodiments were chosen and described in order to explain certain principles of the invention and their practical application, to thereby enable others skilled in the art to make and utilize various embodiments of the present invention, as well as various alternatives and modifications thereof As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A lamp for a vehicle, comprising:

a first reflector disposed entirely on a first side of an LED array and including an elliptical reflective surface that has a first focal point and a second focal point, the first reflector reflecting light emitted from the LED array, the first reflector being coupled to a module; and a second reflector disposed on a second side of the LED array and including a parabolic reflective surface that has a third focal point, the second reflector reflecting the light reflected by the first reflector, the second side being opposite to the first side with respect to a line perpendicular to a surface of the LED array, the surface of the LED array being disposed on the module, wherein the LED array includes:

a first array configured to produce a high beam; and a second array disposed parallel to the first array and configured to produce a low beam, and wherein the first focal point of the first reflector lies on a center of the second array.

2. The lamp of claim 1, further comprising an aspherical lens, wherein the aspherical lens is provided in front of the LED array.

3. A lamp for a vehicle, comprising:

a first reflector disposed entirely on a first side of an LED array and including an elliptical reflective surface that has a first focal point and a second focal point, the first reflector reflecting light emitted from the LED array, the first reflector being coupled to a module; and a second reflector including a planar reflective surface and disposed on a second side of the LED array, the second reflector reflecting the light by reflected the first reflector, the second side being opposite to the first side with respect to a line perpendicular to a surface of the LED array, the surface of the LED array being disposed on the module, wherein the LED array includes:

a first array configured to produce a high beam; and a second array disposed parallel to the first array and configured to produce a low beam, and wherein the first focal point of the first reflector lies on a center of the second array.

4. The lamp of claim 3, further comprising an aspherical lens, wherein the aspherical lens is provided in front of the LED array.

5. The lamp of claim 3, wherein the LED array includes an LED chip, and wherein the elliptical reflective surface of the first reflector has a third focal point, the first and third focal points being spaced apart by a distance corresponding to a width of the LED chip.

* * * * *